US009240623B2

(12) United States Patent
Wang

(10) Patent No.: US 9,240,623 B2
(45) Date of Patent: Jan. 19, 2016

(54) WIDE-BAND MICROWAVE HYBRID COUPLER WITH ARBITRARY PHASE SHIFTS AND POWER SPLITS

(75) Inventor: Leah Wang, Fremont, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 828 days.

(21) Appl. No.: 13/436,740

(22) Filed: Mar. 30, 2012

(65) Prior Publication Data

US 2012/0256699 A1 Oct. 11, 2012

Related U.S. Application Data

(60) Provisional application No. 61/474,238, filed on Apr. 11, 2011.

(51) Int. Cl.
*H01P 5/18* (2006.01)
*H01P 3/08* (2006.01)

(52) U.S. Cl.
CPC ..... *H01P 5/187* (2013.01)

(58) Field of Classification Search
CPC ..... H01P 5/18; H01P 5/12; H01P 5/184; H01P 5/185
USPC ..... 333/109, 110, 111, 112, 115, 116, 117, 333/118, 119, 25
See application file for complete search history.

(56) References Cited

U.S. PATENT DOCUMENTS

| | | | | | |
|---|---|---|---|---|---|
| 3,484,724 | A * | 12/1969 | Podell | 333/112 |
| 3,617,952 | A | 11/1971 | Beech | |
| 3,626,332 | A | 12/1971 | Barbatoe | |
| 3,737,810 | A | 6/1973 | Shelton | |
| 3,768,042 | A * | 10/1973 | Friend et al. | 333/116 |
| 3,777,284 | A * | 12/1973 | Schultz | 333/116 |
| 4,013,981 | A * | 3/1977 | Shintani et al. | 333/28 R |
| 4,139,827 | A * | 2/1979 | Russell | 333/116 |
| 4,185,258 | A * | 1/1980 | Cote et al. | 333/262 |
| 4,954,790 | A * | 9/1990 | Barber | 332/164 |
| 7,034,633 | B2 * | 4/2006 | Passiopoulos et al. | 333/116 |
| 2010/0225416 | A1 * | 9/2010 | Ingalls et al. | 333/116 |

FOREIGN PATENT DOCUMENTS

WO WO-02/069440 9/2002

* cited by examiner

*Primary Examiner* — Dean Takaoka
(74) *Attorney, Agent, or Firm* — McDermott Will & Emery LLP

(57) ABSTRACT

A device for coupling microwave signals with arbitrary phase shifts and power split ratios over broadband may comprise a first branch comprising a cascade of first stripline sections connected to one another. A second branch may comprise a cascade of second stripline sections connected to one another. A single stripline section and a capacitor may be coupled in series to at least one of the branches. The first stripline sections of the first branch and the corresponding second stripline sections of the second branch form broadside coupled stripline sections. Those cascaded coupled stripline sections may be arranged to have a monotonically changing horizontal offsets but at a uniform vertical distance.

20 Claims, 7 Drawing Sheets

300

| Design Parameters | 160 degree 3-dB hybrid (1-10GHz) | 20 degree 5-dB hybrid (0.5-5GHz) |
|---|---|---|
| Ground plane spacing (mil) | 123 | 123 |
| Conductor Spacing (mil) | 1 | 2.5 |
| Conductor Length per section (mil) | 368 | 736 |
| Conductor thickness (mil) | 0.5 | 0.5 |
| Conductivity (S/m) | 1.00E+06 | 1.00E+06 |
| Capacitor (pF) | 0.1 | 0.1 |
| Stripline stub length (mil) | 2900 | 5700 |
| Conductor width--section 1 (mil) | 112 | 112 |
| Conductor offset--section 1 (mil) | 214 | 214 |
| Coupling Coefficient--section 1 (dB) | -35 | -35 |
| Conductor width--section 2 (mil) | 111.8 | 111.8 |
| Conductor offset--section 2 (mil) | 194 | 194 |
| Coupling Coefficient--section 2 (dB) | -30.2 | -30.2 |
| Conductor width--section 3 (mil) | 97.8 | 97.8 |
| Conductor offset--section 3 (mil) | 138.5 | 138.5 |
| Coupling Coefficient--section 3 (dB) | -20 | -20 |
| Conductor width--section 4 (mil) | 91.8 | 91.8 |
| Conductor offset--section 4 (mil) | 112 | 112 |
| Coupling Coefficient--section 4 (dB) | -14.8 | -14.8 |
| Conductor width--section 5 (mil) | 85.8 | 85.8 |
| Conductor offset--section 5 (mil) | 89.5 | 92.5 |
| Coupling Coefficient--section 5 (dB) | -10 | -9.6 |
| Conductor width--section 6 (mil) | 71.8 | 71.8 |
| Conductor offset--section 6 (mil) | 72 | 71.5 |
| Coupling Coefficient--section 6 (dB) | -6 | -5.5 |
| Conductor width--section 7 (mil) | 43.8 | 43.8 |
| Conductor offset--section 7 (mil) | 41 | 40 |
| Coupling Coefficient--section 7 (dB) | -2.8 | -2.4 |
| Conductor width--section 8 (mil) | 14.8 | 14.8 |
| Conductor offset--section 8 (mil) | 6.5 | 6 |
| Coupling Coefficient--section 8 (dB) | -0.9 | -0.89 |

FIG. 3

WIDE-BAND MICROWAVE HYBRID COUPLER WITH ARBITRARY PHASE SHIFTS AND POWER SPLITS

CROSS-REFERENCE TO RELATED APPLICATIONS

This application claims the benefit of priority under 35 U.S.C. §119 from U.S. Provisional Patent Application 61/474,238 filed Apr. 11, 2011, which is incorporated herein by reference in its entirety.

STATEMENT REGARDING FEDERALLY SPONSORED RESEARCH OR DEVELOPMENT

Not applicable.

FIELD OF THE INVENTION

The present invention generally relates to microwave communication, and more particularly to wide-band microwave hybrid couplers with arbitrary phase shifts and power splits.

BACKGROUND

Hybrid couplers are important components in microwave integrated circuits and systems. Next generation broadband networks and systems may require broadband hybrid couplers. Conventional hybrid couplers with single octave bandwidth may be insufficient for these next generation broadband networks and systems. In addition, as microwave systems become more compact with a higher level of integration, components with integrated functionalities are desired.

SUMMARY

In some aspects, a device for coupling microwave signals with arbitrary phase shifts and power split ratios is described. The hybrid coupler may comprise a cascade of coupled stripline sections connected to one another. Each coupled stripline pair is configured to be broadside coupled at a predetermined horizontal offsets. A single stripline section and a capacitor may be coupled in series to the coupler for tuning purposes. The hybrid coupler may be directional. The hybrid coupler may be configured to be asymmetric. The multi-section coupled striplines may be arranged to have a monotonically changing horizontal offset and a uniform vertical distance.

In another aspect, a method for coupling microwave signals with arbitrary phase shifts and power split ratios is described. The method comprises coupling an input signal to an input port of the hybrid coupler. The hybrid coupler may comprise a cascade of stripline sections connected to one another. A transmit signal may be derived from a transmit port of the coupler. A coupled signal may be derived from a coupled port of the coupler. A desired center frequency may be determined by the length of each stripline section. A desired phase shift between the transmit port and the coupled port may be determined by the total length of the hybrid coupler. A desired power splitting ratio between the transmit port and the coupled port may be deter mined by a value of a uniform vertical distance between each coupled stripline pair. Broadband phase response and power ratio over frequency may be determined by a monotonically changing horizontal offset profile along cascaded stripline sections. A single stripline stub maybe appended to either transmit port or coupled port to offset the phase tilts against frequency. A varactor maybe appended to either transmit port or coupled port for fine tuning the flatness of either phase or power splitting ratio.

In yet another aspect, a hybrid coupler for coupling microwave signals with arbitrary phase shifts and power split ratios is described. The hybrid coupler comprises a cascade of coupled stripline sections connected to one another, an input port at one end of the cascade to the top stripline, and a transmit port at the other end of the cascade to the top stripline. an isolated port also at the other end of the cascade but to the bottom stripline, and a coupled port also at input end of the cascade but to the bottom stripline. The coupled stripline sections are arranged to have a monotonically changing horizontal offset and a uniform vertical distance.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein:

FIG. 3 is a table illustrating example design parameters of the device of FIG. 1A in two implementations, according to certain aspects;

DETAILED DESCRIPTION

The present disclosure is directed, in part, to a hybrid coupler for coupling microwave signals with arbitrary phase shifts (e.g., 0-360 degrees) and arbitrary power split ratios (e.g., 0-20 dB). The hybrid coupler may comprise a cascade of coupled stripline sections connected to one another. A single stripline section (e.g., a transmission line stub) and a capacitor (e.g., a varicap) may be coupled in series to either the transmit port or coupled port of the coupler. The cascaded stripline sections may be arranged to have a monotonically changing horizontal offset, and a uniform vertical distance determined by a thickness of a thin laminate layer separating each coupled stripline pair.

In one aspect, The wideband hybrid coupler may integrate functionalities of a power splitter, a phase shifter, and a variable attenuator. Therefore, the wideband hybrid coupler can be an important component for enabling integrated broadband systems.

The wideband hybrid coupler may be based on asymmetric directional couplers comprising cascaded multi-section coupled striplines. In some aspects, each pair of coupled stripline section may be broadside coupled through horizontal offsets while keeping a fixed vertical distance. The vertical distance may be set by a thin laminate layer where striplines can be printed on both sides of the thin laminate layer. In some aspects, the multiple cascaded sections may have monotonically changing horizontal offsets between each pair, which may lead to monotonically changing coupling coefficients.

Figure 1C:
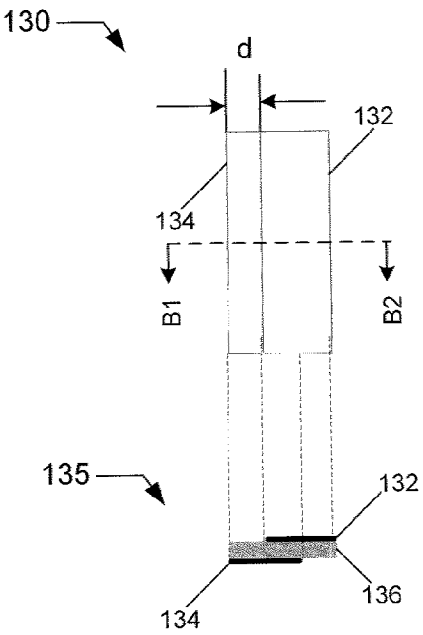
FIGS. 1A-1C are conceptual diagrams illustrating an example of a device for coupling microwave signals with arbitrary phase shifts and power splits and associated stripline sections, according to certain aspects.
Figure 1B:
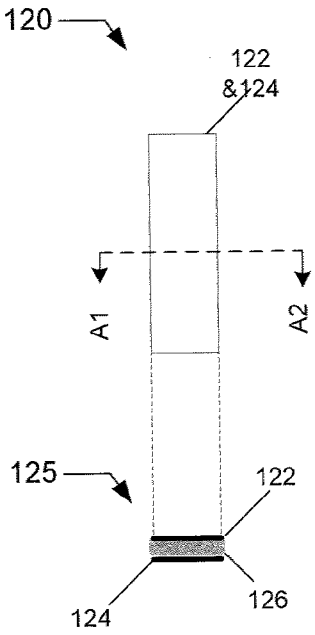
Figure 1A:
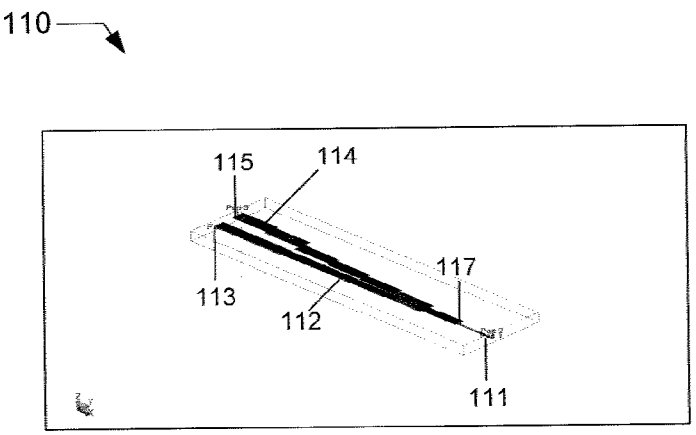

FIGS. 1A-1C are conceptual diagrams illustrating an example of a device 110 for coupling microwave signals with arbitrary phase shifts and power splits and associated stripline sections 120 and 130, according to certain aspects. Device 110 is a wide band (e.g., 1-10 GHz) microwave hybrid coupler and includes a first branch 112, a second branch 114, an input port 111, a transmit port 113, a coupled port 117, and an isolated port 115. In an aspect, a single stripline (e.g., a transmission line stub, not shown in FIG. 1A for simplicity) may be coupled to either or both of the transmit port 113 or coupled port 115. First branch 112 may be formed by cascading a number of first stripline sections (e.g., 122 and 132). Second branch 114 may be formed by cascading a number of second stripline sections (e.g., 124 and 134). The first and second stripline sections are made of a conductor material (e.g., copper, aluminum, silver, gold, etc.). Each stripline section from the first branch couples to a corresponding stripline section from the second branch to form a coupled stripline section.

In practice, the first branch may be formed on the top side of a thin laminate—which may be covered by a top substrate layer followed by a top ground plane; the second branch may be formed on the bottom side of the same thin laminate which is covered by a bottom substrate layer followed by a bottom ground plane. The top and bottom substrate layers and ground planes are not shown in FIG. 1A for simplicity. While the vertical distance between first branch 112 and second branch 114 are fixed by a thickness of the thin laminate layer (e.g., a non-conducting material) not shown in FIG. 1A for simplicity (see items 126 and 136), first branch 112 and second branch 114 are not horizontally aligned. The horizontal offset between the individual first stripline sections and corresponding second stripline sections, however, monotonically increase as moving away from input port 111 (or coupled port 117). This monotonic increase in horizontal offset results in a monotonic change of coupling coefficients along the cascaded coupled stripline pairs that allows for an arbitrary phase shift between transmit and coupled signals. The vertical distance between the first and second branches determines the power split ratio between the transmit and coupled signals. The flatness of power and phase over a wide bandwidth (e.g. over a fractional bandwidth of 150%) is achieved by selecting the right combination set of cascaded coupling coefficients as discussed in more detail herein.

An input signal (e.g., a microwave signal) may be applied at input port 111. The applied signal may be split, by the hybrid coupler 110 into transmit and coupled signals accessible from transmit port and coupled port, respectively. Hybrid coupler 110 may be configured to provide arbitrary phase shifts and power split ratios between the transmit and coupled signals. Conventional hybrid couplers are based on either lumped element transformers or striplines with phase shift limited to either 0°, 90°, or 180°. The limitation is due to the absence of extra tuning elements in the designs. In the subject technology, an arbitrarily phase shift between transmit signal and coupled signal and any desired power split ratio (e.g., a ratio of the transmit signal power to the coupled signal power) can be provided by adjusting various parameters of hybrid coupler 110, as discussed in more detail herein.

FIG. 1B shows a top view 120 and a side view 125 of a first stripline 122 and a respective second stripline 124 with no horizontal offsets. The side view 125, which is a cross sectional view at A1-A2, also shows the laminate layer 126 that fills the vertical space between first stripline 122 and the respective second stripline 124. FIG. 1C shows a top view 130 and a side view 135 of a first stripline 132 and a respective second stripline 134 with a horizontal offset equal to d, as seen from top view 130. The side view 135, which is a cross sectional view at B1-B2, also shows the laminate layer 136 that fills the vertical space between first stripline 132 and the respective second stripline 134.

Figure 2A:
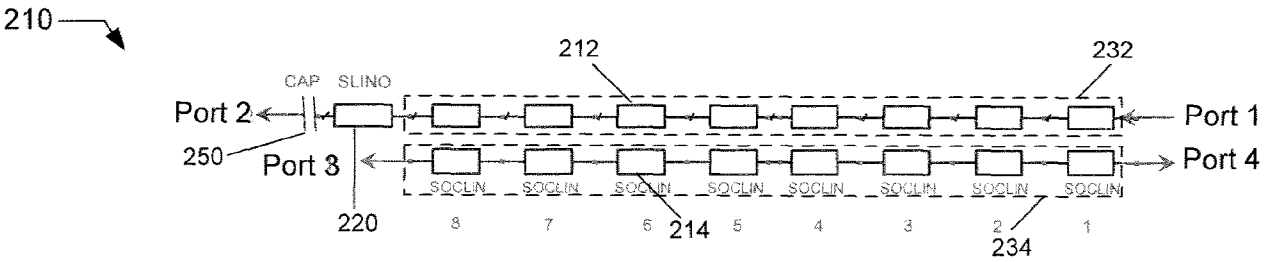
FIGS. 2A-2B are schematic diagrams illustrating example equivalent circuits of the device of FIG. 1A, according to certain aspects.
Figure 2B:
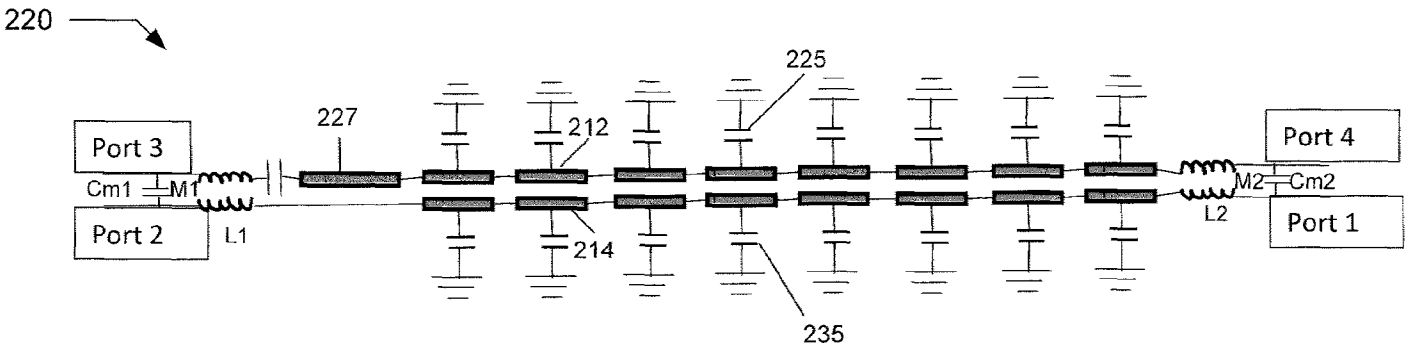

FIGS. 2A-2B are schematic diagrams illustrating example equivalent circuit diagrams 210 and 220 of device 110 of FIG. 1A, according to certain aspects. Equivalent circuit diagram 210 shows a first cascade 232 of striplines, and a second cascade 234 of striplines. Striplines 212 and 214 represent one set of coupled stripline section (e.g., 122 and 124 or 132 and 134). 220 may represent the single stripline (e.g., a transmission line stub). Capacitor 250 may be varicap, so that the capacitance value C can be adjusted by, for example, applying an external voltage to the varicap. In the aspect represented by FIG. 2A, the single stripline and capacitor 250 are coupled to the transmit port (e.g., port 2). In an aspect, the single stripline and capacitor 250 may be coupled to the coupled port (e.g., port 4) or both ports (e.g., ports 2 and 4). Equivalent circuit diagram 210, for simplicity, does not show parasitic element. Equivalent circuit diagram 220 shown in FIG. 2B depicts parasitic capacitances between the first stripline sections and the top ground plane (e.g. parasitic capacitances 225) and parasitic capacitances between the second stripline sections and the bottom ground plane (e.g. parasitic capacitances 235) and inductances and capacitances associated with ports 1, 2, 3 and 4. In the equivalent circuit diagram 220, $C_{m1}$, $C_{m2}$, $M_1$, $M_2$, $L_1$, and $L_2$ are parasitic reactance associated with the hybrid coupler ports. The added transmission line stub 227 may serve as a linear tuning distributed LC network. Distributed configuration may yield linear and broadband response whereas a lumped LC circuit may be limited in bandwidth.

FIG. 3 is a table 300 illustrating example design parameters of device 110 of FIG. 1A, according to certain aspects. The working principle for the design of hybrid coupler 110 is based on the fact that the transfer matrix for an asymmetric cascaded coupler is no longer orthogonal, thus it can be tailored to an arbitrary phase shift depending on the condition imposed by a specific set of coupling coefficients. Table 300 summarizes the design parameters or recipes for two example hybrid couplers. One example coupler is a 3-dB hybrid coupler (e.g., a hybrid coupler with 3-dB power split ratio) with 160 degree phase shift operating within the frequency range of 1 to 10 GHz; and the other example coupler is a 5-dB hybrid coupler with 20 degree phase shift operating within the frequency range of 0.5 to 5 GHz. Both couplers may represent a factor of 10 in frequency range or 164% in fractional bandwidth.

As seen from table 300, for the first and second stripline sections of the examples shown in table 300, length (e.g., conductor length per section), thickness (e.g., conductor thickness), and spacing (e.g., conductor spacing) are fixed, where as width (e.g., conductor width) and horizontal offset (e.g., conductor offset) varies for various sections (e.g., stripline section) along the cascades forming the first and second branches. Also the calculated coupling coefficients associated with each horizontal offset are shown.

The theoretical foundation behind the design of the hybrid coupler 110 of FIG. 1A is briefly described in the following. For each coupled stripline section (e.g., 132 and 134 of FIG. 1C), the transmitted signal is given by:

$$\frac{j(Z_{oe}-Z_{oo})\sin\theta}{2\cos\theta+j(Z_{oe}+Z_{oo})\sin\theta}$$

Where $Z_{oe}$ and $Z_{oo}$ are normalized even mode and odd mode impedances, which are normalized with respect to the characteristic impedance $(Z_eZ_o)^{1/2}$. The coupled signal is given by:

$$\frac{2}{2\cos\theta+j(Z_{oe}+Z_{oo})\sin\theta}$$

For n-elements, the transfer matrix is:

$$\prod_{r=1}^{n}\begin{bmatrix}\cos\theta & jZ_{oer}\sin\theta\\ j/Z_{oer}\sin\theta & \cos\theta\end{bmatrix}=\begin{bmatrix}A_n & jB_n\\ jC_n & D_n\end{bmatrix}$$

Where θ (=length/λ) is the stripline section length in terms of wavelength. The power division between the transmit signal and coupled signal is given by:

$$\frac{(A_n-D_n)+j(B_n-C_n)}{2}$$

and the phase difference is:

$$\phi=\tan^{-1}\frac{B_n-C_n}{A_n-D_n}$$

It can be shown that for asymmetric couplers, $A_n$ is not equal to $D_n$ so that the phase difference ϕ deviates from 90 degrees over operating bandwidth. Instead, the phase difference is a linear function of frequency. For example, for cascaded two-section coupler case (e.g., hybrid coupler 110) the phase shift between the transmit signal and coupled signal is given by:

$$\phi=\tan^{-1}\left(\cot\theta\frac{(Z_{oe1}+Z_{oe2})-(1/Z_{oe1}+1/Z_{oe2})}{(Z_{oe2}/Z_{oe1}-Z_{oe1}/Z_{oe2})}\right)$$

which can be arbitrarily adjusted by changing parameters as shown in table 300.

For couplers with many cascaded sections, it may be very challenging to mathematically solve the cascaded matrix and it may involve iterative steps of trial solutions and numerical validation. Using the trial solutions, however, may eventually lead to the design recipes.

Figure 4A:
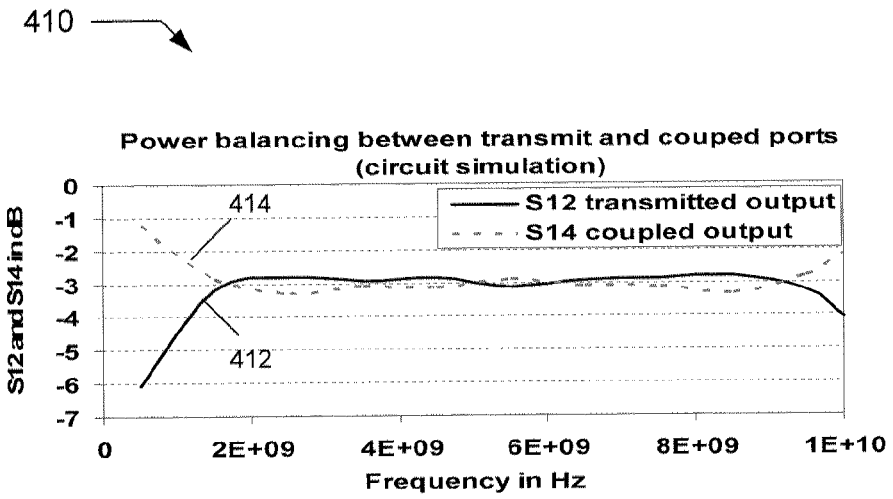
FIGS. 4A-4B are diagrams illustrating exemplary plots of power balance between transmit and coupled ports of the device of FIG. 1A, that were derived from circuit simulations, according to certain aspects.
Figure 4B:
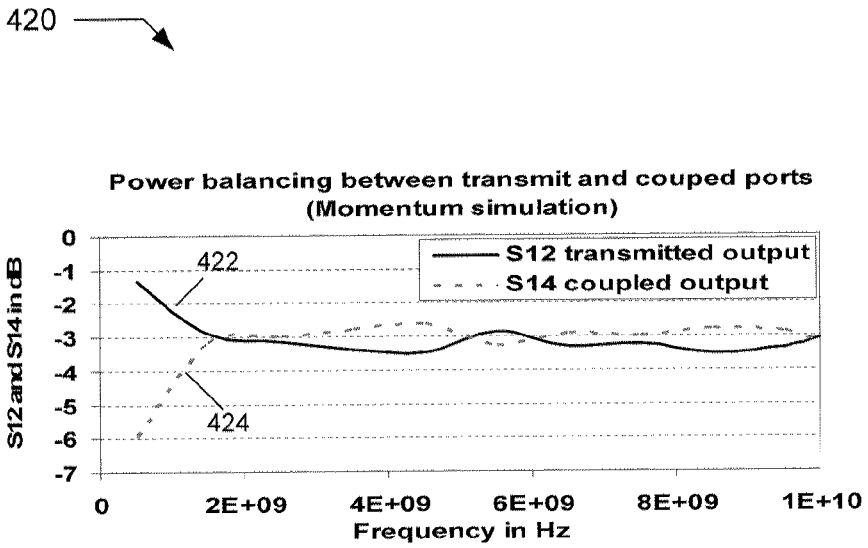

FIGS. 4A-4B are diagrams illustrating exemplary plots 410 and 420 of power balance showing power balance between transmit and coupled ports of device 110 of FIG. 1A, according to certain aspects. Power balance plots 410 are the result of a circuit simulation (e.g., using circuit diagram 220 of FIG. 2B). Parameters S12 and S14 represent transmitted and coupled power in dB with respect to total input power, which are shown by plots 412 and 414, respectively. Power balance plots 420 are the result of a finite element (FE) momentum electromagnetic (EM) layout simulation (herein after "momentum simulation"). Parameters S12 (e.g., transmit power) and S14 (e.g., coupled power) are shown by plots 422 and 424, respectively. The results shown in FIGS. 4A-4B correspond to the 160 degree 3-dB hybrid coupler of table 300 of FIG. 3. The power ratio can be controlled by adjusting the thickness of the laminate layer (e.g., item 126 of FIG. 1*b*). As seen from the variation of plots 412 and 414, the signal power split is substantially flat across a wide band of operating frequency (approximately 1-10 GHz), validating the wideband nature of the subject hybrid coupler. The power balance flattening to less than 0.5 dB is achievable over a fractional bandwidth of over 150 percent.

Figure 5A:
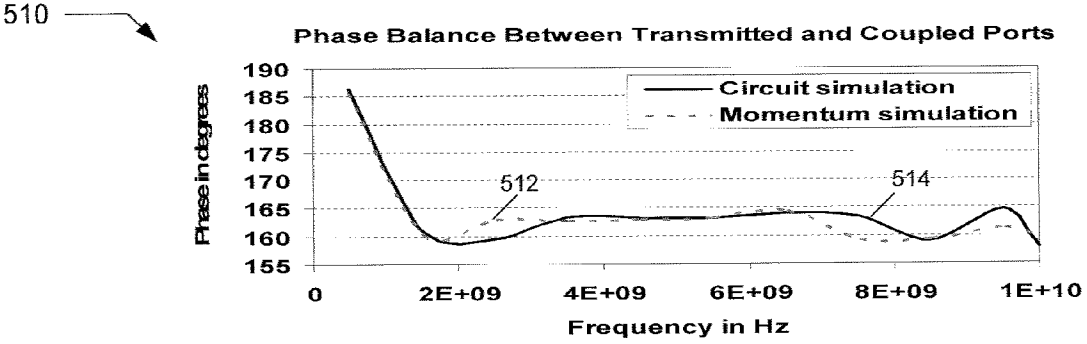
FIGS. 5A-5B are diagrams illustrating exemplary plots of phase balance and isolation performance of the device of FIG. 1A, that were derived from layout full-wave simulations, according to certain aspects.
Figure 5B:
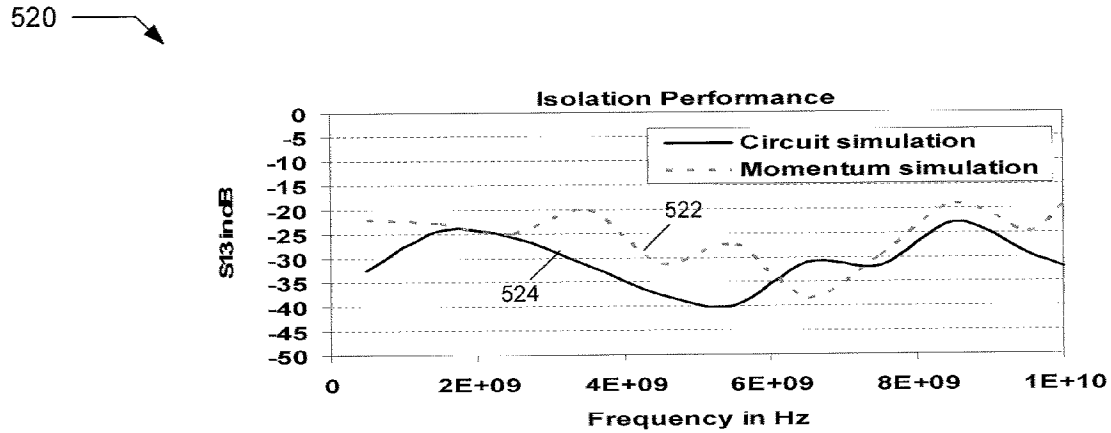

FIGS. 5A-5B are diagrams illustrating exemplary plots of phase balance 510 and isolation performance 520 of device 110 of FIG. 1A, according to certain aspects. Phase balance plots 510 includes a plot 512 and a plot 514. Plot 512 is the result of momentum simulation, whereas plot 514 is the result of a circuit simulation (e.g., using circuit diagram 220 of FIG. 2B). By adjusting the length of the single stripline (e.g., transmission line stub), flatness of the phase balance is achievable to less than five degrees over a fractional bandwidth of more than 150 percent. The result shown in FIG. 5A indicate a phase balance variation of approximately 5 degrees over an approximate frequency range of 1-10 GHz.

FIG. 5B shows the isolation performance of the device 110 over a wide frequency range as obtained by circuit simulation (e.g., plot 524) and momentum simulation (e.g., plot 522). The isolation performance indicates the isolation between the transmitted port (e.g., port 113 of FIG. 1A) and the coupled port (e.g., port 117 of FIG. 1A) and is seen to be better than approximately 20 dB. Further optimization in the device layout can be done to completely eliminate any layout induced artifact that may have caused less desirable performance as shown by the momentum simulation results.

Figure 6A:
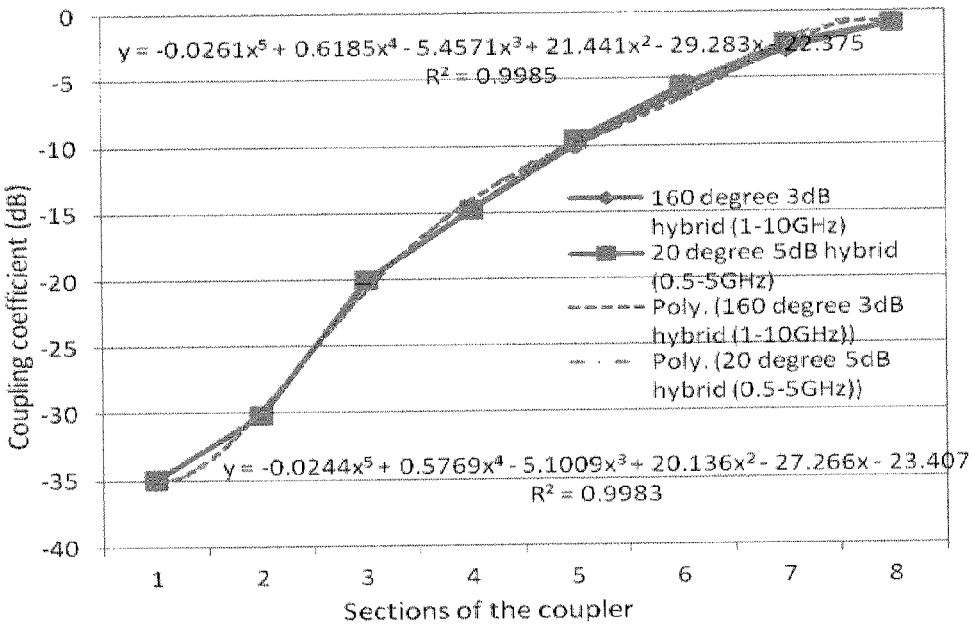
FIGS. 6A-6B are diagrams illustrating exemplary plots of coupling coefficient and impedance profiles of the device of FIG. 1A, according to certain aspects.
Figure 6B:
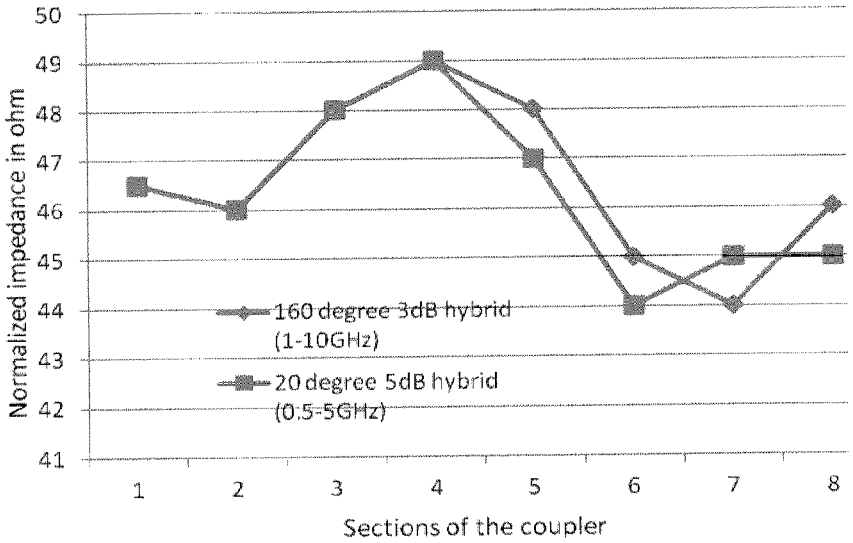

FIGS. 6A-6B are diagrams illustrating exemplary plots of coupling coefficient profile 610 and impedance profile 620 of device 110 of FIG. 1A, according to certain aspects. FIG. 6A shows plots of the coupling coefficient profiles for various coupled sections (e.g., first and second stripline sections) for the two example designs shown in table 300 of FIG. 3. The polynomial fits (broken lines) were applied to both plots. It can be seen that the coupling coefficient profiles are almost the same for both designs. The $5^{th}$ order polynomial fits are almost identical with very high fidelity. The convergence in the coupling coefficient profiles for the two designs thus validates the proposed design methodology.

FIG. 6B shows plots of the normalized impedance profiles along the coupler sections for the two designs. Again, almost identical profiles are seen for both designs. This further validates the proposed design using a different figure of merit.

Figure 7:
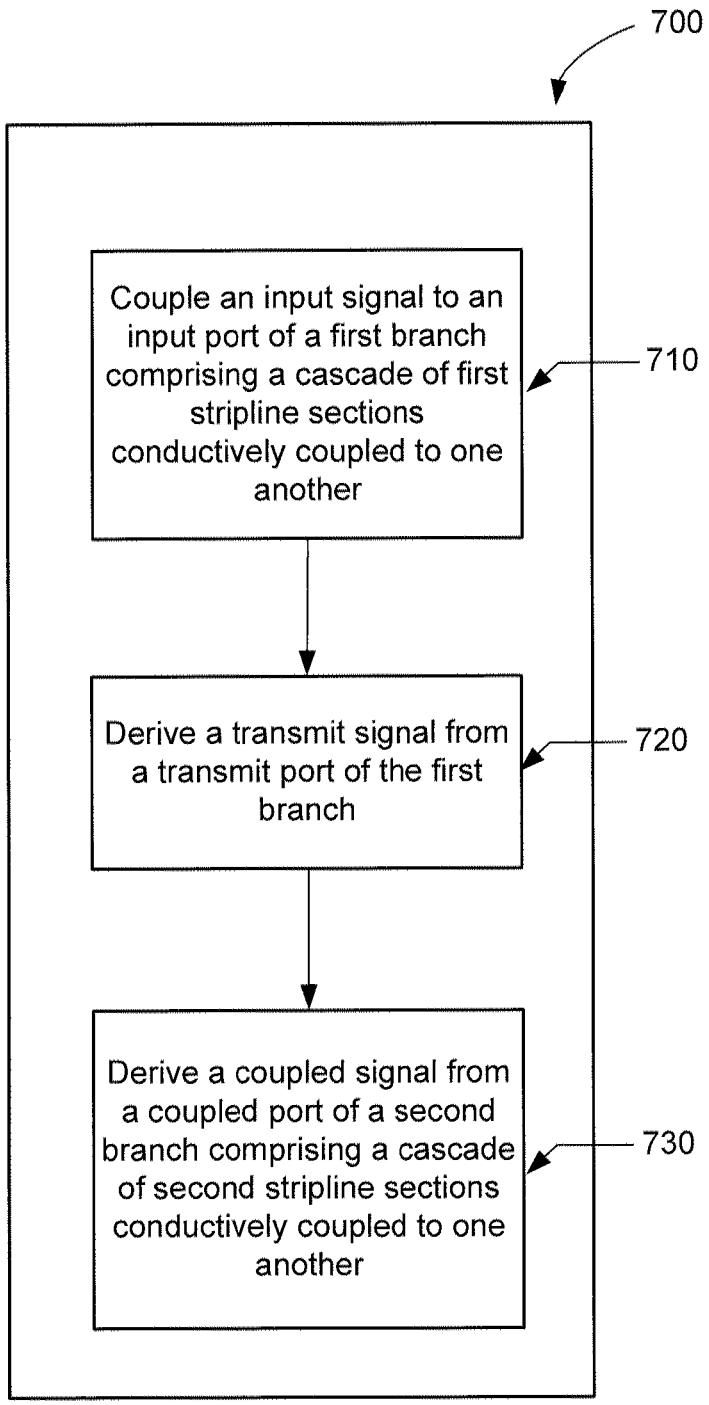
FIG. 7 is a flow diagram illustrating an example method for coupling microwave signals with arbitrary phase shifts and power splits, according to certain aspects.

FIG. 7 is a flow diagram illustrating an example method 700 for coupling microwave signals with arbitrary phase shifts and power splits, according to certain aspects. Method 700 begins at operation 710, an input signal is coupled to an input port (e.g., port 1 of FIG. 2A) of a first branch (e.g., 112 of FIG. 1A or 232 of FIG. 2A). The first branch may comprise a cascade of first stripline sections (e.g., 122 of FIG. 1B or 132 of FIG. 1C) connected to one another. A transmit signal may be derived from a transmit port (e.g., port 2 of FIG. 2A) of the first branch (operation 720). At operation 730, a coupled signal may be derived from a coupled port (e.g., port 4 of FIG. 2A) of the second branch (e.g., 114 of FIG. 1A or 234 of FIG. 2A). The second branch may comprise a cascade of second stripline sections (e.g., 125 of FIG. 1B or 135 of FIG. 1C) connected to one another. Each stripline section from the first branch couples to a corresponding stripline section from the second branch to form a coupled stripline section. A desired phase shift between the transmit port and the coupled port may be determined by the total length of the asymmetric coupler. The broadband response may be determined by a monotonically changing horizontal offset (e.g., d in FIG. 1C) profile along the cascaded coupled stripline sections. A power splitting ratio between the transmit port and the coupled port may be determined by a value of a uniform vertical distance (e.g., thickness of 126 of FIG. 1B) between the first and the second branches.

According to certain aspects, the flatness of power and phase over a wide bandwidth may be achieved by selecting the right combination set of cascaded coupling coefficients. The power splitting ratio may be adjusted by changing the vertical spacing between two striplines in each coupled pair, which may correspond to the thickness of the thin laminate. The center operating frequency may be determined by the length of each coupler section. In some aspects, the phase shift may be determined by the total length of the coupler. In some aspects, simulations show that power flatness of less than 0.5 dB and phase flatness of less than 5 degrees can be achieved over a fractional bandwidth of over 150% with an arbitrary phase shift (e.g., 0-360 degrees) and power split (e.g., 0-20 dB). The working principle for this design may be based on the fact that the transfer matrix for an asymmetric cascaded coupler may no longer be orthogonal and thus, it can be tailored to an arbitrary phase shift depending on the condition imposed by a specific set of coupling coefficients.

In some aspects, the subject technology is related to microwave systems. In some aspects, the subject technology may provide wideband hybrid couplers with arbitrary phase shift and power splitting ratios, which may offer integrated functionalities to enable next generation broadband microwave systems or networks. Potential markets for these types of components can include commercial and/or military/defense industries in the areas of communication, sensing, energy, robotics, electronics, information technology, medicine, or other suitable areas. In some aspects, the subject technology may be used in the advanced sensors, data transmission and communications, and radar and active phased arrays markets.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in Willis of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range is specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. A device for coupling microwave signals, the device comprising: a first branch comprising a cascade of first stripline sections conductively coupled to one another; a second branch comprising a cascade of second stripline sections conductively coupled to one another; and a single stripline section and a capacitor coupled in series to at least one of the branches, wherein: the first stripline sections of the first branch and the second stripline sections of the second branch are arranged to have a monotonically changing horizontal offset and a uniform vertical distance, the length of the single stripline section is adjusted to tune the flatness of a phase balance between signals at a transmit port and a coupled port of the first and the second branch, two ends of one of the first or second branches are configured as an input port and the transmit port, and two ends of another one of the first or second branches are configured as an isolated port and the coupled port, the single stripline section is not coupled with any stripline section on an opposite side of a laminate layer, and the flatness of the phase balance is achievable to less than five degrees over a fractional bandwidth of over 150 percent.

2. The device of claim 1, wherein the first branch and the second branch are disposed on opposite sides of top and bottom sides of a planar laminate layer, and wherein the thickness of the planar laminate layer determines the vertical distance.

3. The device of claim 1, wherein the first and second stripline sections are adapted to have the same length and thickness and are made of a conductive material, and wherein the first stripline sections of the first branch and the second stripline sections of the second branch are broadside coupled in corresponding pairs with a monotonically changing horizontal offset and a uniform vertical distance.

4. The device of claim 3, wherein the respective stripline sections of the first branch and the second branch are configured to have the same width, and wherein the horizontal offsets of the corresponding pairs vary along the length of the coupler.

5. The device of claim 1, wherein the lengths of the first and second striplines are the same and are adjusted to tune an operating frequency of the device.

6. The device of claim 1, wherein a capacitance of the capacitor is adjusted to fine tune a phase shift between signals at the transmit port and the coupled port.

7. The device of claim 1, wherein the single stripline section and the capacitor are coupled in series to either or both of the transmit port and the coupled port.

8. The device of claim 1, wherein the horizontal offset increases as moving away from the input port.

9. The device of claim 1, wherein the horizontal offset is configured to provide an arbitrary phase shift over broadband between signals at the transmit port and the coupled port.

10. The device of claim 1, wherein the vertical distance is adjusted to achieve a desired power splitting ratio between signals at the transmit port and the coupled port.

11. The device of claim 1, wherein an overall length of the first or second branches are adjusted to achieve a desired phase shift between signals at the transmit port and the coupled port.

12. The device of claim 1, wherein a thickness of a laminate layer between the first and second branches determines the vertical distance.

13. The device of claim 1, wherein a flatness of a power splitting ratio of less than 0.5 dB is achievable over a fractional bandwidth of over 150 percent.

14. A method for coupling microwave signals, the method comprising:

coupling an input signal to an input port of a first branch, the first branch comprising a cascade of first stripline sections conductively coupled to one another;

deriving a transmit signal from a transmit port of the first branch; and deriving a coupled signal from a coupled port of a second branch, the second branch comprising a cascade of second stripline sections conductively coupled to one another, wherein:

a desired phase shift between the transmit port and the coupled port is determined by a monotonically changing horizontal offset, a power splitting ratio between the transmit port and the coupled port is determined by a value of a uniform vertical distance between the first and the second branches, the desired phase shift between the transmit port and the coupled port is determined by a monotonically changing horizontal offset profile along the cascaded coupled stripline sections formed between the two branches, a single stripline section and a capacitor are coupled in series with one of the first branch or the second branch, and the method further comprises adjusting a capacitance of the capacitor to fine tune a phase shift between signals at the transmit port and the coupled port.

15. The method of claim 14, wherein the first branch and the second branch are disposed on opposite sides of top and bottom sides of a planar laminate layer, wherein the thickness of the planar laminate layer is determined by the vertical distance, wherein the first and second stripline sections are adapted to have the same length and thickness and are made of a conductive material.

16. The method of claim 14, wherein a flatness of a phase balance between signals at the transmit port and the coupled port is determined by the coupling coefficient profile along the cascaded coupled stripline sections, and the coupling coefficient profile is enabled by varying horizontal offset of each coupled stripline section, and wherein the flatness of the phase balance is achievable to less than five degrees over a fractional bandwidth of over 150 percent.

17. The method of claim 14, wherein the first and second striplines have the same length and an operating frequency of coupler signals is determined by the length of the first or second striplines.

18. The method of claim 14, wherein at least some stripline sections from the first branch are adapted to couple to at least some corresponding stripline sections from the second branch and forms a coupled stripline section.

19. A hybrid coupler comprising:

a first branch comprising a first cascade of first stripline sections conductively coupled to one another;

a second branch comprising a second cascade of second stripline sections conductively coupled to one another;

an input port at one end of the first cascade, a transmit port at the other end of the first cascade, an isolated port at one end of the second cascade, and a coupled port at the other end of the second cascade, wherein:

the first branch and the second branch are disposed on opposite sides of top and bottom sides of a planar laminate layer, and the first stripline sections of the first branch and the second stripline sections of the second branch are broadside coupled through each corresponding pair and are arranged to have a monotonically changing horizontal offset, to provide an arbitrary phase shift over broadband between signals at the transmit port and the coupled port, and a uniform vertical distance, the length of the single stripline section is adjusted to tune the flatness of the phase balance between signals at the transmit port and the coupled port of the first and the second branch, the vertical distance is adjusted to achieve a desired power splitting ratio between signals at the transmit port and the coupled port, and a flatness of the power splitting ratio of less than 0.5 dB is achievable over a fractional bandwidth of over 150 percent.

20. The hybrid coupler of claim 19, further comprising a single stripline section and a capacitor coupled in series to at least one of the branches, wherein the flatness of the phase balance is achievable to less than five degrees over a fractional bandwidth of over 150 percent, and wherein a capacitance of the capacitor is adjusted to fine tune a phase shift between signals at the transmit port and the coupled port.

* * * * *